US007086640B2

(12) United States Patent
Carmouche

(10) Patent No.: US 7,086,640 B2
(45) Date of Patent: Aug. 8, 2006

(54) APPARATUS FOR EXTRACTING CONCRETE FORMS AND ELEMENTS RELATED TO CONCRETE FORMWORK

(75) Inventor: James M. Carmouche, Houston, TX (US)

(73) Assignee: Industrial Innovations L.L.C., Houston, TX (US)

( * ) Notice: Subject to any disclaimer, the term of this patent is extended or adjusted under 35 U.S.C. 154(b) by 122 days.

(21) Appl. No.: 10/706,455

(22) Filed: Nov. 12, 2003

(65) Prior Publication Data

US 2004/0094754 A1 May 20, 2004

Related U.S. Application Data

(63) Continuation-in-part of application No. 10/000,705, filed on Oct. 31, 2001, now Pat. No. 6,676,110.

(60) Provisional application No. 60/244,752, filed on Oct. 31, 2000.

(51) Int. Cl.
*E21B 19/00* (2006.01)

(52) U.S. Cl. ..... 254/30

(58) Field of Classification Search ..... 254/30, 254/29 R, 131, 132
See application file for complete search history.

(56) References Cited

U.S. PATENT DOCUMENTS 5,224,687 A * 7/1993 Geckler et al. ..... 254/30

* cited by examiner

*Primary Examiner*—Robert C. Watson
(74) *Attorney, Agent, or Firm*—Vinson & Elkins L.L.P.; Richard R. Ruble

(57) ABSTRACT

A mechanical assembly for pulling the form work away from a concrete structure after the concrete structure has cured. The form work is typically wood or steel and requires a large mechanically force to free it from the concrete structure. The form puller assembly includes a lever assembly, a fulcrum assembly, and a form pulling assembly. The user pulls down on the opposite end of the lever assembly generating a mechanical force sufficient to free the form work from the concrete structure. Also, the mechanical assembly may include at least one embedded element extracting assembly for removing vertically oriented elements embedded in the soil and/or concrete.

17 Claims, 9 Drawing Sheets

FRONT VIEW

SIDE VIEW

APPARATUS FOR EXTRACTING CONCRETE FORMS AND ELEMENTS RELATED TO CONCRETE FORMWORK

CROSS-REFERENCE TO RELATED APPLICATIONS

The present application is a continuation-in-part of U.S. Ser. No. 10/000,705, filed on Oct. 31, 2001 now U.S. Pat. No. 6,676,110, which claims the benefit of the filing date of U.S. Provisional Patent Application Ser. No. 60/244,752, filed on Oct. 31, 2000.

BACKGROUND OF THE INVENTION

1. Field of the Invention

The present invention generally relates to construction equipment and more particularly to a device for extracting concrete form work and other concrete installation-related elements.

2. Description of the Prior Art

It is often difficult to remove the form from a concrete structure once the concrete has cured because the concrete becomes mechanically connected with the form material which is typically wood or steel.

U.S. Pat. No. 2,099,592 to Barton provides a form puller device having a lever 13, a fulcrum 9, 10, 12, and a J-shaped hook 16 (FIG. 1). The Barton device may be used to engage particular concrete forms 2 having a lip 7 and extracting such forms by exerting force on the lever arm 13. The Barton device, however, is limited in its application as it can engage and extract on a particular type of form (i.e., a form with a lip). Moreover, the Barton device does not provide a means for extracting other embedded concrete-installation related elements such as rods, posts, and stakes. Furthermore, the Barton device does not provide a lever arm which is versatile in accommodating the comfort and safety of the operator while maximizing the force exerted on the form or installation element.

Accordingly, it would be desirable to have a single device which would allow a worker to have a mechanical advantage for: (1) forcing a concrete form—regardless of the type—away from the concrete structure, and (2) extracting embedded concrete-installation related elements—such as rods, posts, and stakes. Furthermore, it would be desirable for such a device to be easily brought to the target location, set up and repositioned each time a new section of the form required removal. Still furthermore, it would be desirable for such a device to have a lever arm which accommodates the safety and comfort of the operator and provides maximum force to facilitate removal of the form or element.

SUMMARY OF THE INVENTION

The form puller apparatus of the present invention includes a lever assembly, a fulcrum assembly, and a form pulling assembly. The fulcrum assembly includes a base to provide stability and a vertically oriented member extending upwardly from the base. The lever assembly includes a horizontal member pivotally connected to the top end of the vertically oriented member of the fulcrum assembly. The horizontal member of the lever assembly has two ends—(1) the first end is rigidly connected to a U shaped handle assembly and (2) the second end is pivotally connected to the form pulling assembly. The form pulling assembly includes a form pulling member having a number of pivot holes spaced along a top portion thereof to allow the form pulling member to be pivotally attached to the second end of lever member at various heights along the length thereof and a section of angled stock at the bottom end. The angled stock is arranged perpendicular to the form pulling member for positioning beneath a section of concrete forming material so that the form material can be extracted as needed by pushing down on the handle of the lever when the angle stock is in place.

The form puller apparatus of the present invention further includes at least one embedded element extracting assembly for removing concrete installation-elements such as bars, rods, spikes, posts, and/or poles. These embedded elements are typically shaped such that the angle stock of the form pulling member cannot engage them to facilitate removal. Each embedded element extracting assembly attaches to the form pulling assembly such that the lever assembly may be employed to remove the concrete installation element targeted for extraction.

BRIEF DESCRIPTION OF THE DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF SPECIFIC EMBODIMENTS OF THE INVENTION

Figure 1:
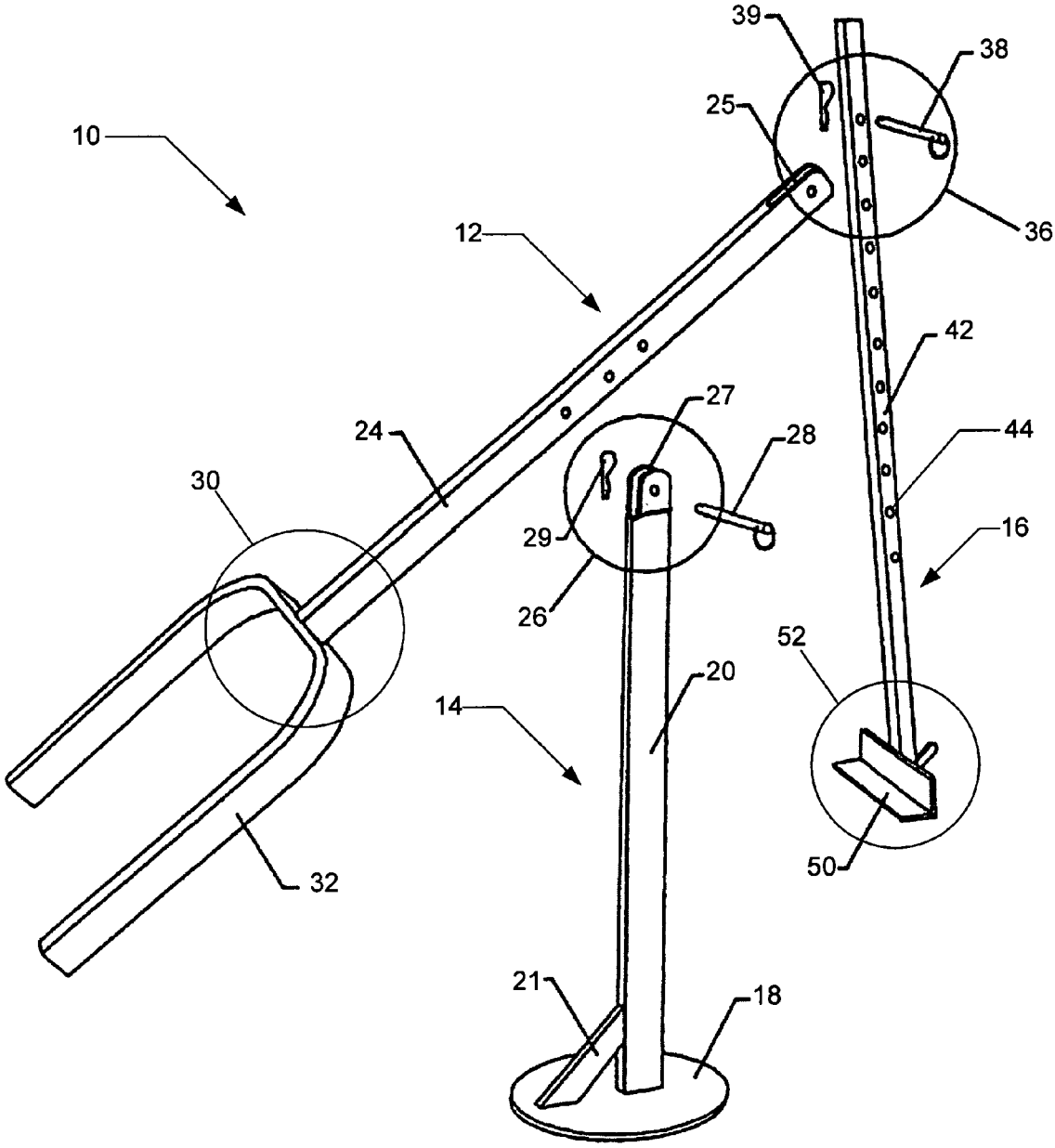
FIG. 1 is an exploded perspective view of an exemplary embodiment of the concrete form puller of the present invention.
Figure 2:
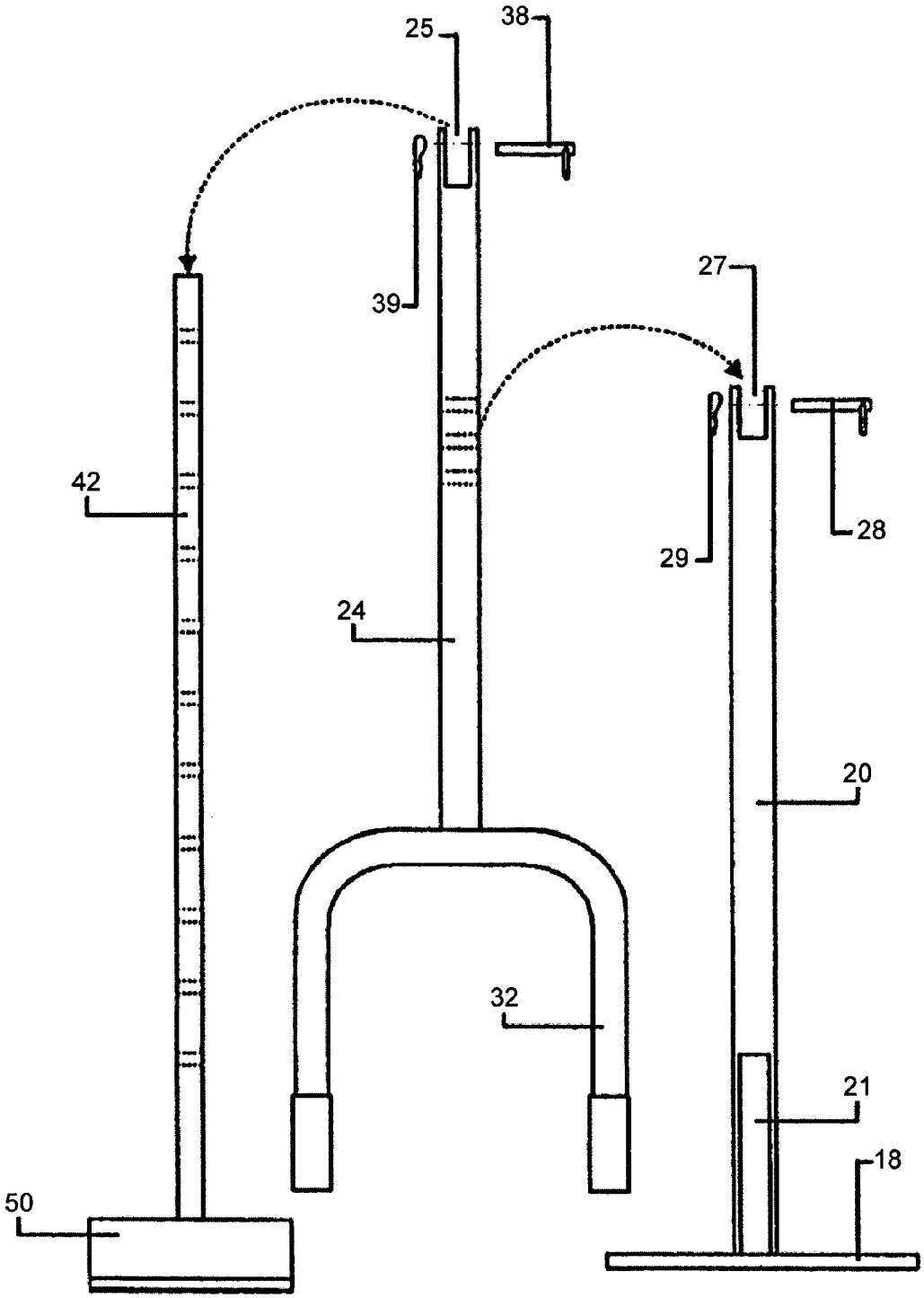
FIG. 2 is an exploded front view of an exemplary embodiment of the concrete form puller of the present invention.
Figure 3:
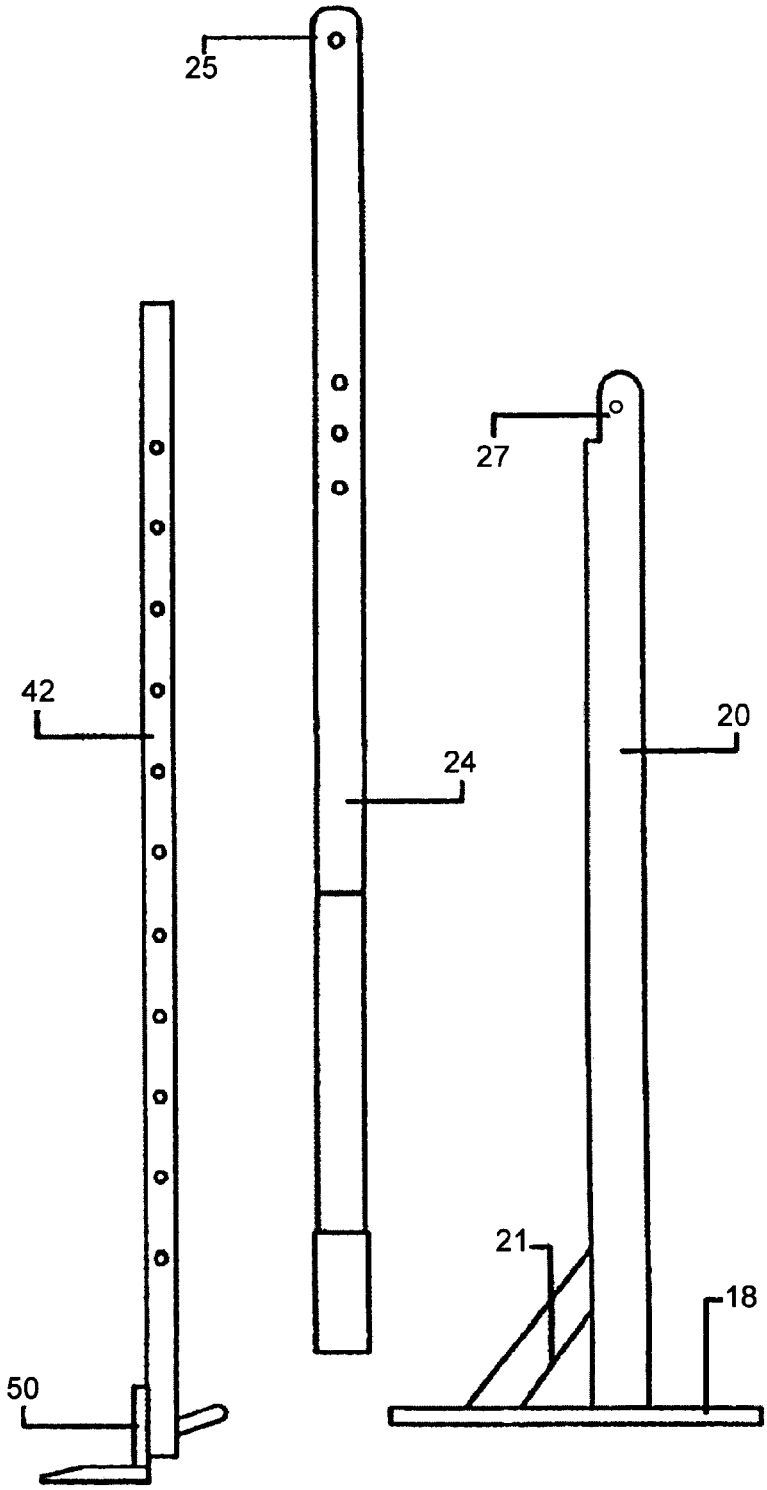
FIG. 3 is an exploded side view of an exemplary embodiment of the concrete form puller of the present invention.
Figure 4:
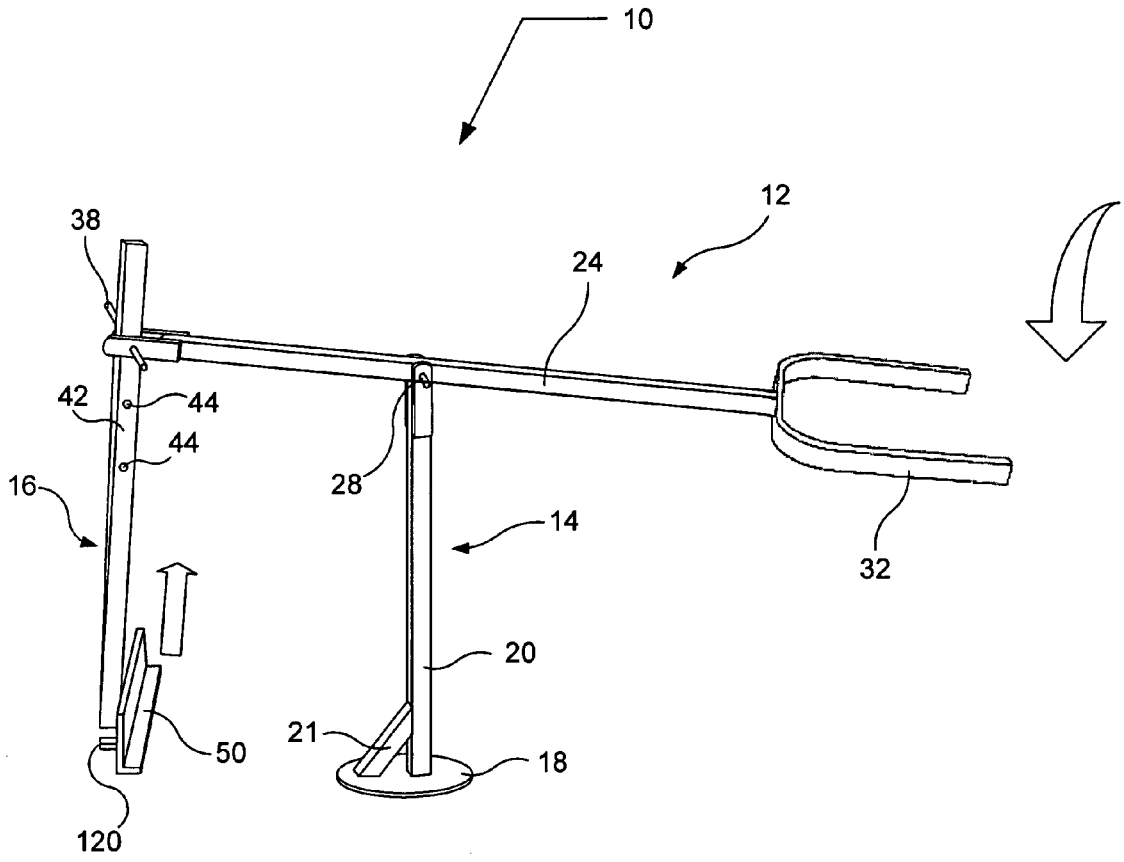
FIG. 4 is a perspective view of an exemplary embodiment of the concrete form puller of the present invention.

A description of certain embodiments of the present invention is provided to facilitate an understanding of the invention. This description is intended to be illustrative and not limiting of the present invention. These and other objects, features, and advantages of the present invention will become apparent after a review of the entire detailed description, the disclosed embodiments, and the appended claims. As will be appreciated by one of ordinary skill in the art, many other beneficial results and applications can be appreciated by applying modifications to the invention as disclosed. Such modifications are within the scope of the claims appended hereto.

FIGS. 1–4 show various aspects of an exemplary embodiment of the concrete form puller of the present invention generally designated 10. Concrete form puller 10 includes a lever assembly generally designated 12, a fulcrum assembly generally designated 14, and a form pulling assembly generally designated 16.

Fulcrum assembly 14 includes a stabilizing base 18 from which a vertically oriented fulcrum member 20 extends upwardly. The vertically oriented fulcrum member 20 has a top end 26 having a pivot hole 27 formed therein. While the stabilizing base 18 is shown being circular in shape, it is intended that the base may be shaped in any manner to facilitate stability. Although this embodiment of the concrete form puller of the present invention includes a stabilizing brace 21 to support the vertically oriented fulcrum member 20, it will be appreciated by one having skill in the art that such a brace is unnecessary if the fulcrum member is designed to support the target load alone.

The lever assembly 12 includes a lever arm member 24 pivotally connected at the top end 26 of the vertically oriented fulcrum member 20 by a pivot pin 28 locked in engagement with the pivot hole 27 by a lock 29. The lever arm member 24 has a first end 30 that is rigidly connected to a U shaped handle assembly 32. The lever arm member 24 has a second end 36 that is pivotally connected by a pin 38 and lock 39 to a form pulling member 42 of the form pulling assembly 16 via pin hole 25. The form pulling member 42 is provided with a number of holes 44 to allow the user to adjust the height of a piece of angle stock 50 rigidly attached to the bottom end 52 of the form pulling member 42. The components of the concrete form puller of the present invention may be fabricated from any sturdy material capable of withstanding the operating load including but not limited to steel tubes, bars, and plates.

In operation, the angle stock portion 50 of the form pulling assembly 16 is positioned beneath a section of concrete form material 64 and pulled away from the concrete structure 66 by pushing down on handle assembly 32 causing form pulling member 16 to move in an upward direction freeing the form 64 from the concrete structure 66. The U shaped handle assembly 32 is provided such that the operator can safely apply the required downward force to extract the concrete form while in a comfortable upright position. The operator is not required to bend over at the waist to apply the force thus reducing the risk of back-related injuries. Moreover, the U shaped handle assembly 32 effectively provides two lever arms such that two operators can deliver a higher force if necessary to remove a form.

Figure 5:
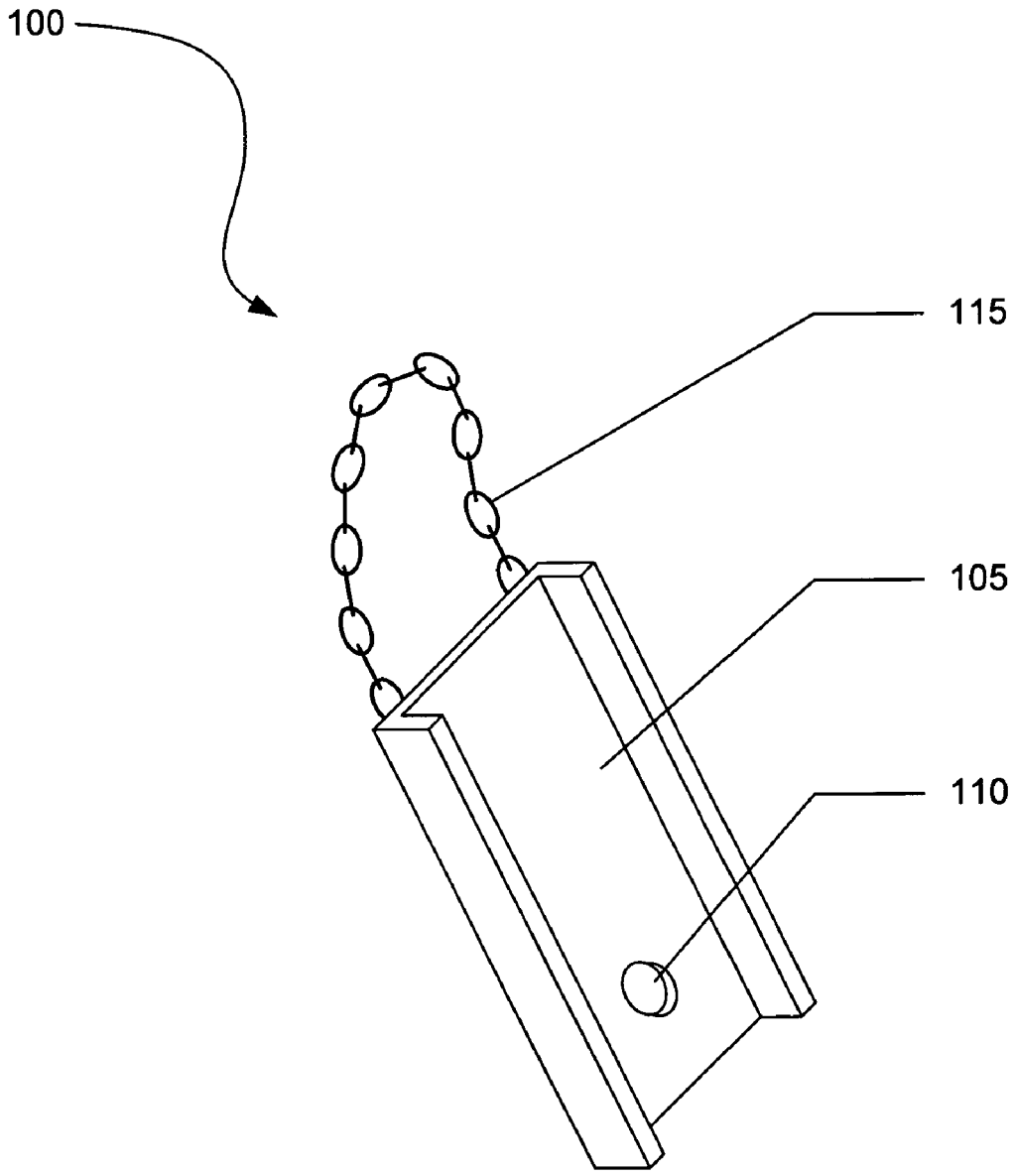
FIG. 5 is a perspective view of a first embodiment of an embedded element extraction assembly of the present invention.
Figure 6:
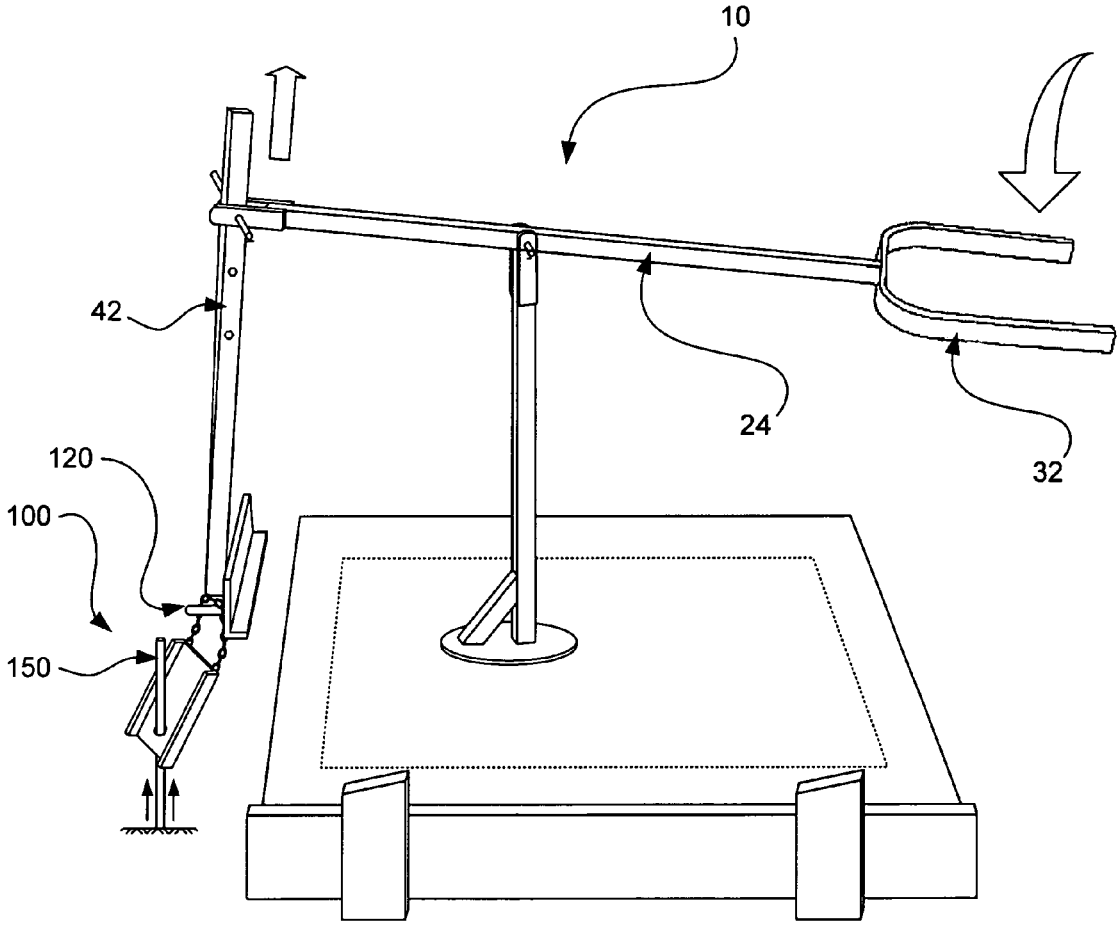
FIG. 6 is a perspective view of the concrete form puller of the present invention in use with the first embedded element extraction assembly embodied in FIG. 5.

In another embodiment of the present invention, as shown in FIGS. 5 and 6, the concrete form puller of the present invention includes at least one element extracting assembly 100 for removing various embedded elements related to concrete installation. For example, the element extracting assembly 100 may facilitate the removal of posts, pins, rods, posts, bars, pegs and/or stakes from the surrounding soil. This embodiment of the element extracting assembly of the present invention includes a body section 105 having a hole 110 formed therein for circumscribing an embedded element 150. The diameter of the hole 110 is selected to be slightly larger than the largest diameter of the embedded element such that the body section 105 can slip over and engage the element. An attaching component 115—such as a chain—connects the element extracting assembly 100 to the form pulling assembly 16.

In operation, the element extracting assembly 100 is hooked onto the form pulling assembly 16 by a chain 115 via pin 120. The body section 105 of the element extracting assembly 100 is fit around the embedded element 150 via the hole 110. As shown in FIG. 6, when a force is exerted downward against the U shaped handle assembly 32 of the lever arm 24, the form pulling member 42 shifts vertically upward and slightly rotates the element extracting assembly 100 such that the element 150 is wedged by the sides of the hole 110. Once a sufficient force is exerted downward against the U shaped handle assembly 32, the element extracting assembly 100 removes the element 150 from its embedded state.

Figure 7:
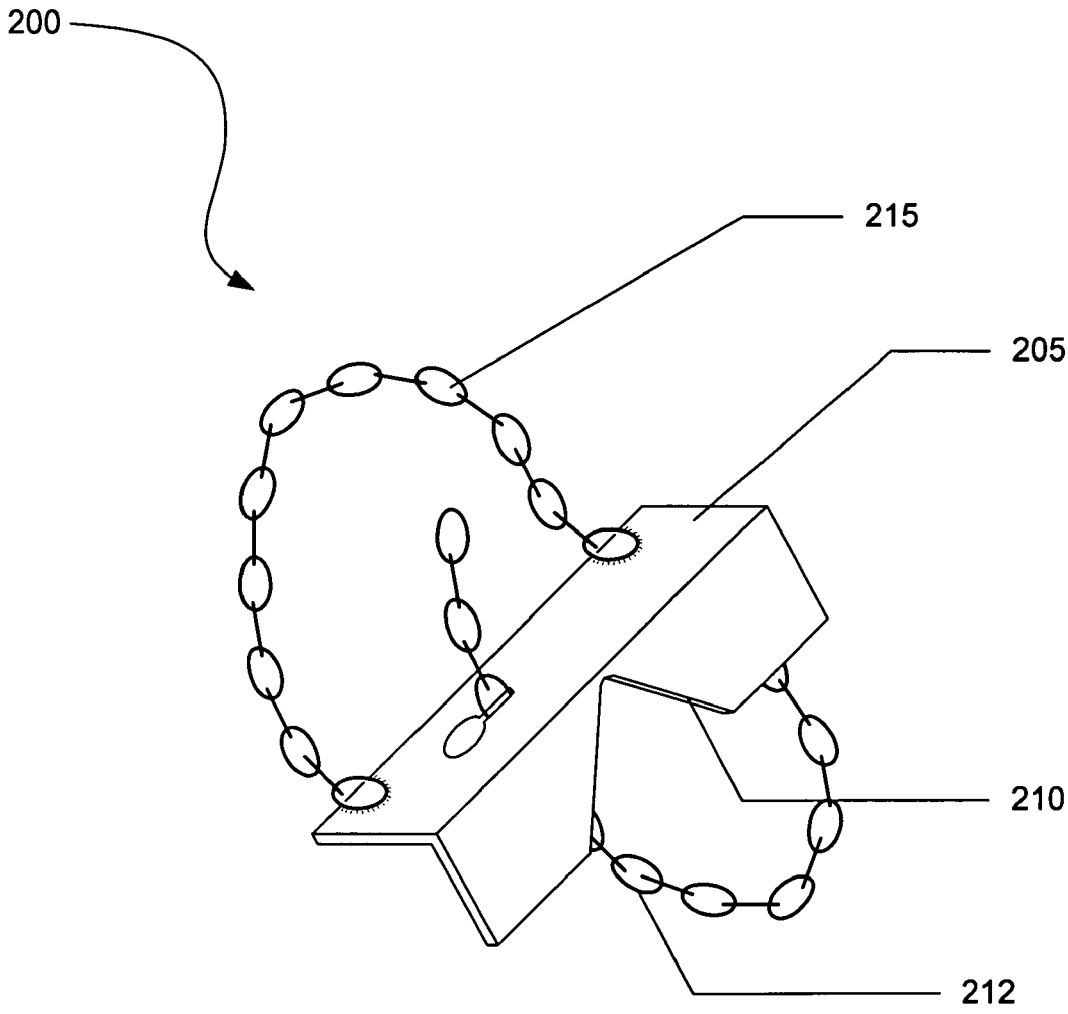
FIG. 7 is a perspective view of a second embodiment of the embedded element extraction assembly of the present invention.
Figure 8:
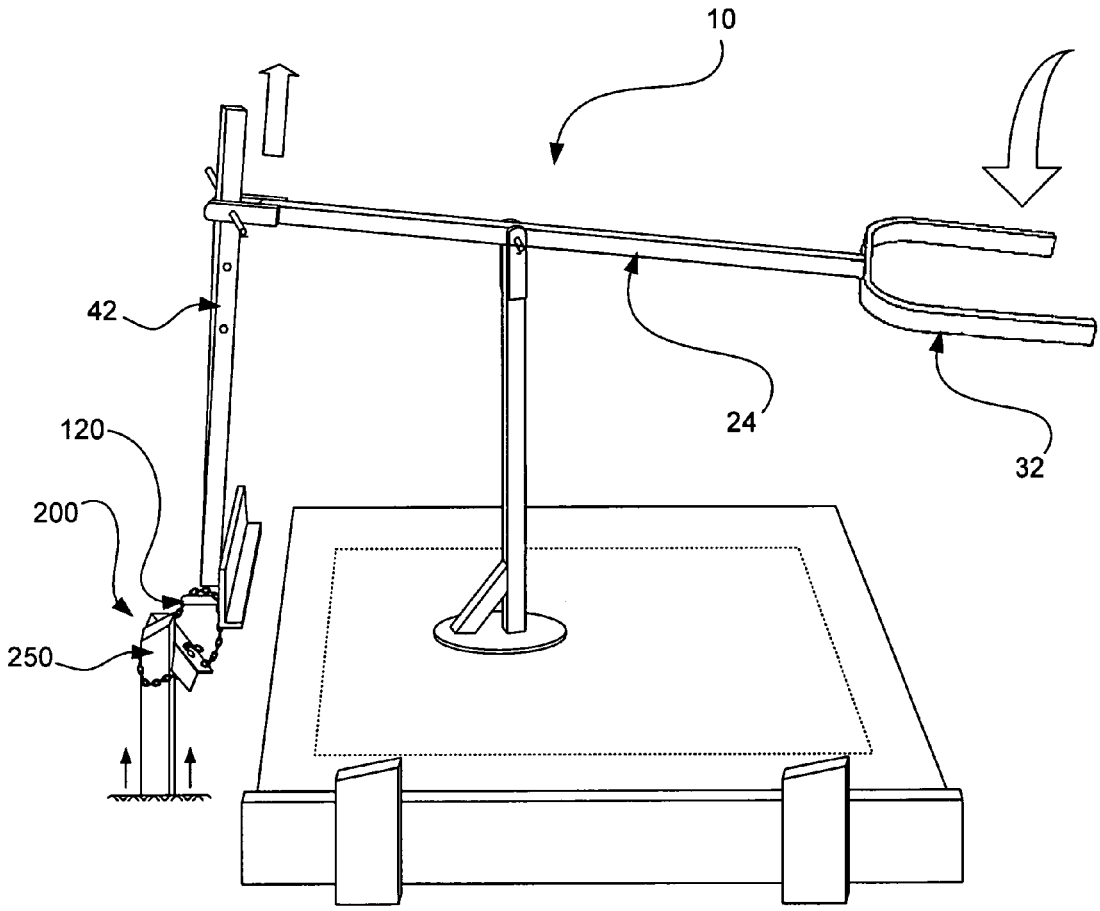
FIG. 8 is a perspective view of the concrete form puller of the present invention in use with the second embedded element extraction assembly embodied in FIG. 7.
Figure 9:
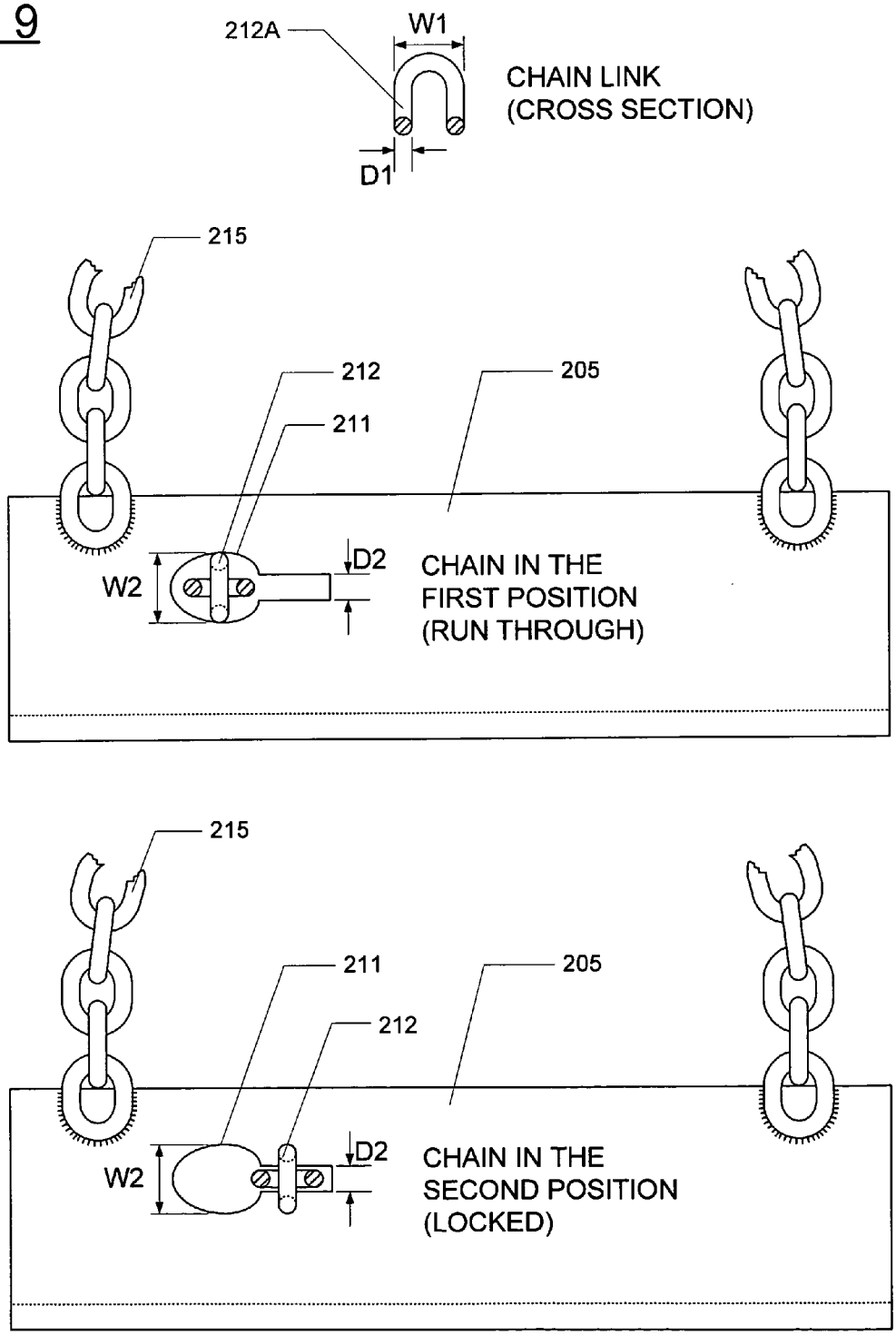
FIG. 9 is a cross-section view of a chain link of the element receiving chain as used in the second embedded element extraction assembly embodied in FIG. 7, and two top views of the second embedded element extraction assembly embodied in FIG. 7 illustrating the element receiving chain in the first position (run through) and the element receiving chain in the second position (locked).

In yet another embodiment of the present invention, as shown in FIGS. 7–9, the concrete form puller of the present invention includes at least one element extracting assembly 200 for removing various embedded elements related to concrete installation. For example, the element extracting assembly 200 may facilitate the removal of posts, pins, rods, posts, bars, pegs and/or stakes from the surrounding soil. This embodiment of the element extracting assembly of the present invention includes a body section 205 having a wedge-shaped recess 210 formed thereon for engaging an embedded element 250 and a keyhole 211 for receiving a chain 212 which is wrapped around the element 250 to pull the element into engagement with the recess. The chain 212 may be any conventional chain composed of links 212A, each link having a width W1 and a diameter D1. The keyhole 211 is arranged to receive and lock the chain in place. The keyhole 211 includes two sections. The first section has a diameter W2 which is larger than the width W1 of the chain links 212A such that the chain can pass therethrough (first position). The second section has a width D2 which is larger than the diameter D1 of the chain links 212A but smaller than the width W1 of the chain links such that the chain can be locked (second position). An attaching component 215—such as a second chain—connects the element extracting assembly 200 to the form pulling assembly 16.

In operation, the element extracting assembly 200 is hooked onto the form pulling assembly 16 by a chain 215 via pin 120. The first chain 212 is wrapped around the element 250 and run through the first section of the keyhole 211 until the embedded element 250 is pulled firmly into the wedge-shaped recess 210. While the chain 212 is being run through the first section of the keyhole 211, it is in the "first position". Once the first chain 212 is pulled tight, the first chain is shifted into the second section of the keyhole 211 to lock the element 250 into the recess 210. While the chain 212 is locked in the second section of the keyhole 211, it is in the "second position". When required, the chain 212 may be shifted between the first position and the second position if the chain needs to be tightened and locked respectively. As shown in FIG. 8, when a sufficient force is exerted downward against the U shaped handle assembly 32 of the lever arm 24, the element extracting assembly 200 removes the element 250 from its embedded state.

In the specification and appended claims: (1) the term "embedded element" is used to mean "a post", "a pin", "a rod", "a post", "a bar", "a peg", "a stake", "a spike", "a pole", "any vertically oriented element embedded in soil", and/or "any vertically oriented element related to concrete installation and embedded in soil"; (2) the term "angle stock" is defined to mean "any structural member having a horizontally flat component for engaging a concrete form from beneath"; (3) the term "attaching component" is used to mean "chain", "a rope", "a wire", a "clip", and/or "any conventional connecting device"; the term "width" with respect to a chain refers to the dimension "W1" indicated in FIG. 9; and the term "diameter" with respect to a chain refers to the dimension "D1" indicated in FIG. 9.

Although the invention has been described with reference to specific embodiments, this description is not meant to be construed in a limited sense. Various modifications of the disclosed embodiments, as well as alternative embodiments of the invention, will become apparent to persons skilled in the art upon reference to the description of the invention. It is, therefore, contemplated that the appended claims will cover such modifications that fall within the scope of the invention.

What is claimed is:

1. A form puller device for extracting the concrete form work from the edges of a concrete slab section after the concrete has cured; the form puller device comprising:

(a) a lever assembly;

(b) a fulcrum assembly;

(c) a form pulling member; and (d) an embedded element extraction assembly;

the fulcrum assembly including a base having a vertically oriented fulcrum tube extending upwardly from the base;

the lever assembly including a tubular lever member pivotally connected to a top end of the fulcrum tube of the fulcrum assembly and having a first end rigidly connected to a U-shaped handle assembly and a second end pivotally connected to the form pulling member;

the form pulling member including a form pulling member tube having a top end and a bottom end and a number of pivot holes spaced along a top portion thereof to allow the form pulling member to be pivotally attached to the second end of the lever assembly at various heights along the length thereof and a section of angled stock connected to the bottom end of the form pulling member tube; the angled stock being perpendicular to the form pulling member tube for positioning beneath a section of concrete forming material so that the forming material can be extracted as needed by pushing down on the U-shaped handle assembly of the lever assembly when the angle stock is in place;

the embedded element extraction assembly including a body component for engaging an embedded element, and an attachment component for connecting the body component to the angled stock.

2. The apparatus of claim 1, wherein the body component of the embedded element extraction assembly comprises a hole formed therein for fitting around the embedded element; said hole having a diameter larger than the diameter of the embedded element.

3. The apparatus of claim 2, wherein the attachment component of the embedded element extraction assembly is a chain, and wherein the angled stock comprises a pin formed to receive the chain to connect the embedded element extraction assembly to the angled stock.

4. The apparatus of claim 3, wherein the vertical member of the fulcrum assembly, the horizontal member of the lever assembly, and the pulling member are fabricated from structural tubing.

5. The apparatus of claim 1, wherein the body component of the embedded element extraction assembly comprises: (i) a wedge-shaped recess for receiving the embedded element, (ii) a first chain for wrapping around the embedded element and biasing the element in engagement with the wedge-shaped recess, and (iii) a keyhole for receiving and locking the first chain in place to hold the embedded element in engagement with the wedge-shaped recess.

6. The apparatus of claim 5, wherein the attachment component of the embedded element extraction assembly is a second chain, and wherein the angled stock comprises a pin formed to receive the second chain to connect the embedded element extraction assembly to the angled stock.

7. The apparatus of claim 6, wherein the vertical member of the fulcrum assembly, the horizontal member of the lever assembly, and the pulling member are fabricated from structural tubing.

8. Apparatus for extracting a concrete form from the edge of a concrete section after the concrete section has cured, said apparatus comprising:

(a) a fulcrum assembly comprising: (i) a vertical member having an upper end and a lower end, and (ii) a stabilizing base rigidly connected to the lower end of the vertical member;

(b) a lever assembly comprising: (i) a horizontal member having a first end and a second end, said horizontal member being pivotally connected to the upper end of the vertical member of the fulcrum assembly at a position between the first end and second end, and (ii) a U-shaped handle assembly rigidly connected to the first end of the horizontal member;

(c) a form pulling assembly comprising: (i) a pulling member having a top end pivotally connected to the second end of the horizontal member of the lever assembly and a bottom end, and (ii) an angle section comprising a flat horizontal element, said angle section rigidly connected to the bottom end of the pulling member, said flat horizontal element arranged for positioning beneath the concrete form to facilitate extraction of the concrete form from the concrete section; and (d) an extraction assembly comprising a body component for engaging an embedded element, and an attachment component for connecting the extraction assembly to the form pulling assembly.

9. The apparatus of claim 8, wherein the body component of the extraction assembly comprises a hole formed therein for fitting around the embedded element; said hole having a diameter larger than the diameter of the embedded element.

10. The apparatus of claim 9, wherein the attachment component of the extraction assembly is a chain, and wherein the angled stock comprises a pin formed to receive the chain to connect the extraction assembly to the form pulling assembly.

11. The apparatus of claim 10, wherein the vertical member of the fulcrum assembly, the horizontal member of the lever assembly, and the pulling member of the form pulling assembly are fabricated from structural tubing.

12. The apparatus of claim 8, wherein the body component of the extraction assembly comprises: (i) a wedge-shaped recess for receiving the embedded element, (ii) a first chain for wrapping around the embedded element and biasing the element in engagement with the wedge-shaped recess, and (iii) a keyhole for receiving and locking the first chain in place to hold the embedded element in engagement with the wedge-shaped recess.

13. The apparatus of claim 12, wherein the attachment component of the extraction assembly is a second chain, and wherein the angled stock comprises a pin formed to receive the second chain to connect the extraction assembly to the form pulling assembly.

14. The apparatus of claim 13, wherein the vertical member of the fulcrum assembly, the horizontal member of the lever assembly, and the pulling member of the form pulling assembly are fabricated from structural tubing.

15. An extraction assembly for engaging an embedded element, said extraction assembly comprising a body component for engaging the embedded element, and an attachment component for connecting the body component to a concrete form puller device; wherein the concrete form puller device may be used to deliver an upward force of sufficient magnitude to extract the embedded element via the extraction assembly; wherein the body component of the embedded element extraction assembly comprises: (i) a wedge-shaped recess for receiving the embedded element, (ii) a first chain for wrapping around the embedded element and biasing the element in engagement with the wedge-shaped recess, and (iii) a keyhole for receiving and locking the first chain in place to hold the embedded element in engagement with the wedge-shaped recess.

16. The apparatus of claim 15, wherein the keyhole comprises: (i) a first section which has a diameter larger than the width of the first chain to permit the first chain to pass therethrough, and (ii) a second section which has a diameter larger than the diameter of the first chain and smaller than the width of the first chain to lock the first chain in place; wherein the first chain is moveable between the first section and the second section.

17. The apparatus of claim 16, wherein the attachment component of the embedded element extraction assembly is a second chain, and wherein the concrete form puller device comprises a pin formed to receive the second chain.

* * * * *